US011179736B2

(12) United States Patent
Lin et al.

(10) Patent No.: US 11,179,736 B2
(45) Date of Patent: Nov. 23, 2021

(54) OUT-OF-WALL WATER DISCHARGING DEVICE

(71) Applicant: FUJIAN XIHE SANITARY WARE TECHNOLOGY CO., LTD., Fujian (CN)

(72) Inventors: Xiaofa Lin, Fujian (CN); Xiaoshan Lin, Fujian (CN); Qiqiao Liu, Fujian (CN); Xiaoqing Deng, Fujian (CN); Zhiwei Chen, Fujian (CN)

(73) Assignee: FUJIAN XIHE SANITARY WARE TECHNOLOGY CO., LTD., Fujian (CN)

( * ) Notice: Subject to any disclaimer, the term of this patent is extended or adjusted under 35 U.S.C. 154(b) by 155 days.

(21) Appl. No.: 16/726,858

(22) Filed: Dec. 25, 2019

(65) Prior Publication Data

US 2021/0039117 A1 Feb. 11, 2021

(30) Foreign Application Priority Data

Aug. 8, 2019 (CN) ..... 201921281359.5

(51) Int. Cl.

| | |
|---|---|
| ***B05B 1/18*** | (2006.01) |
| ***E03C 1/04*** | (2006.01) |
| ***B05B 15/652*** | (2018.01) |

(52) U.S. Cl.

CPC ..... *B05B 1/185* (2013.01); *B05B 15/652* (2018.02); *E03C 1/0409* (2013.01)

(58) Field of Classification Search

CPC ..... B05B 1/18; B05B 1/185; B05B 15/60; B05B 15/62; B05B 15/65; B05B 15/652; B05B 15/654; B05B 15/658; B05B 15/68; E03C 1/0409

See application file for complete search history.

(56) References Cited

U.S. PATENT DOCUMENTS

| | | | | |
|---|---|---|---|---|
| 6,425,149 | B1 * | 7/2002 | Wang | E03C 1/0404 285/181 |
| 7,097,122 | B1 * | 8/2006 | Farley | E03C 1/0409 239/553 |
| 8,070,076 | B2 * | 12/2011 | Erickson | F16L 27/087 239/587.2 |
| 8,382,011 | B1 * | 2/2013 | Baldacchino | B05B 15/65 239/587.1 |
| 9,700,909 | B2 * | 7/2017 | Leber | B05B 15/65 |
| 2006/0208111 | A1 * | 9/2006 | Tracy | E03C 1/0409 239/587.2 |
| 2016/0097476 | A1 * | 4/2016 | Peterson | B05B 1/185 285/184 |

* cited by examiner

*Primary Examiner* — Darren W Gorman
(74) *Attorney, Agent, or Firm* — JCIPRNET

(57) ABSTRACT

The disclosure discloses an out-of-wall water discharging device, including connecting pipes, a fixing base, a rotating base rotatably connected to a fixing base through the clutch assembly, a rotating tube rotatably connected to the rotating base through the connecting element, and a water discharging member rotatably connected to the rotating tube through a ball head element communicating with each other. The above solution can achieve rotation in at least three axial directions to adjust the angle of the water discharging end.

9 Claims, 4 Drawing Sheets

OUT-OF-WALL WATER DISCHARGING DEVICE

CROSS-REFERENCE TO RELATED APPLICATION

This application claims the priority benefit of China application serial no. 201921281359.5, filed on Aug. 8, 2019. The entirety of the above-mentioned patent application is hereby incorporated by reference herein and made a part of this specification.

BACKGROUND

Technical Field

The present disclosure relates to the field of sanitary ware, and particularly relates to an out-of-wall water discharging device.

Description of Related Art

In conventional technologies, the water discharging end of an out-of-wall water discharging device cannot be adjusted from three axial directions, including from the pitch angle, the left-right angle and the rotating angle of water discharging port. Therefore, there is a need to provide an out-of-wall water discharging device capable of adjusting the angle of water discharging end from three axial directions.

SUMMARY

The following is a summary of the subject matter of the disclosure, and the summary is not intended to limit the scope of the claims.

The purpose of the embodiment of the present disclosure is to provide an out-of-wall water discharging device capable of at least rotating along three axial directions to adjust the water discharging end.

In order to achieve the above purpose, an embodiment of the present disclosure relates to an out-of-wall water discharging device, including: a connecting pipe that communicates with a pipe in a wall and extends out of the wall; a fixing base that is securely connected to and communicates with the connecting pipe; a rotating base that is rotatably connected to and communicates with the fixing base along a first axis; a clutch assembly that is configured to position the rotating base at a number of discrete positions when the rotating base rotates relative to the fixing base; rotating tubes that are rotated relative to the rotating base along a second axis perpendicular to the first axis and communicate with the rotating base; a connecting element that includes a first connecting member and a second connecting member in a tubular shape; wherein the first connecting member is screwed into the rotating tube, and a first position-limiting portion is provided inside one end of the first connecting member facing the rotating base; one end of the second connecting member is screwed into the rotating base, and the other end thereof extends out of the rotating base and extends into the first connecting member and is externally provided with a second position-limiting portion; the first position-limiting portion and the second position-limiting portion are engaged and the end surface of the rotating tube and the end surface of the rotating base are close to each other; a water discharging member that communicates with the rotating tube; and a ball head element that is connected to the rotating tube and the water discharging member, such that the water discharging member is rotated three-dimensionally relative to the rotating tube or rotated along a third axial direction.

Compared with the conventional technologies, the above solution has the following advantageous effects:

The above technical solution can realize rotation in three axial directions for adjusting the angle of the water discharging end. The first connecting member is screwed into the rotating tube, such that the end surface of the rotating tube and the end surface of the rotating base are close to each other, so that an aesthetic sense of the configuration can be improved and the structure is simple. A gasket is arranged between the first position-limiting portion and the end surface of the rotating base, and the gasket is matched with the end surface of the rotating base, which facilitates the connecting pipe to smoothly rotate relative to the rotating base.

BRIEF DESCRIPTION OF THE DRAWINGS

In order to more clearly illustrate the technical solutions in the embodiments of the present disclosure, the drawings used in the description of the embodiments will be briefly described below. Obviously, the drawings described in the following description are some embodiments of the present application, those skilled in the art can derive other drawings based on these drawings without any inventive effort.

DESCRIPTION OF THE EMBODIMENTS

The technical solutions in the embodiments of the present application are described below with reference to the accompanying drawings in the embodiments of the present application.

Figure 1:
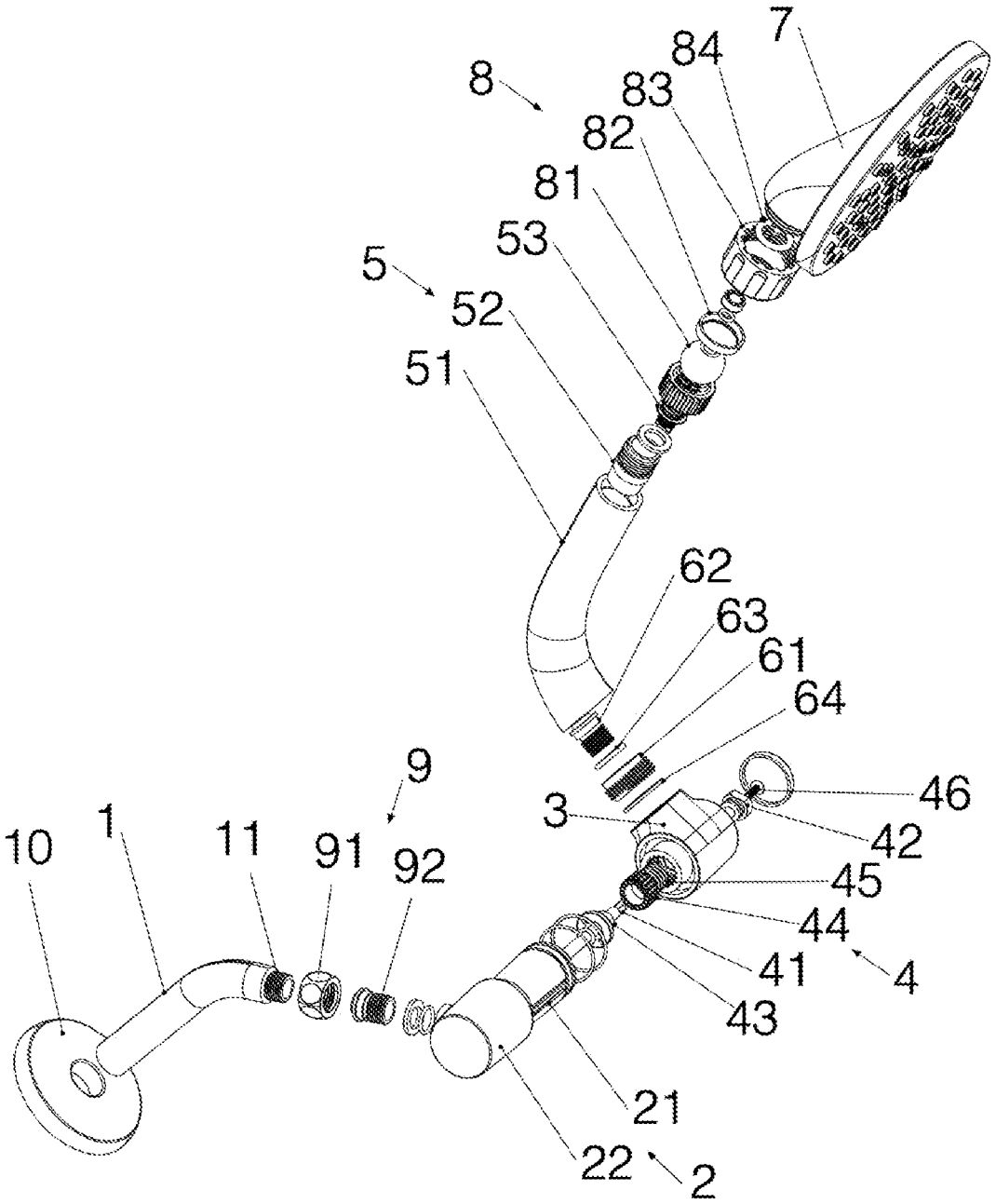
FIG. 1 is an exploded perspective view of an embodiment of an out-of-wall water discharging device.
Figure 2:
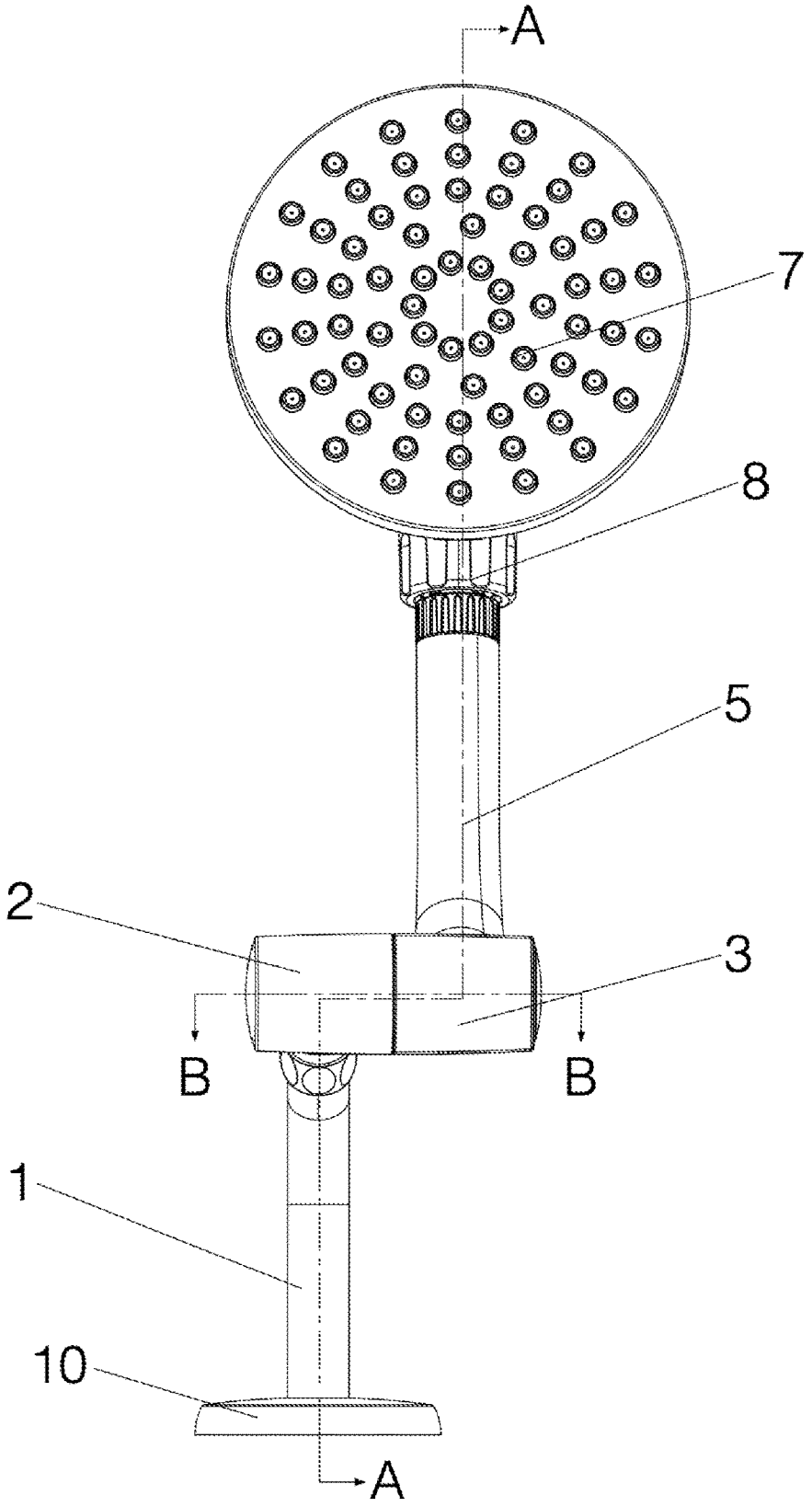
FIG. 2 is a front view of the out-of-wall water discharging device.
Figure 3:
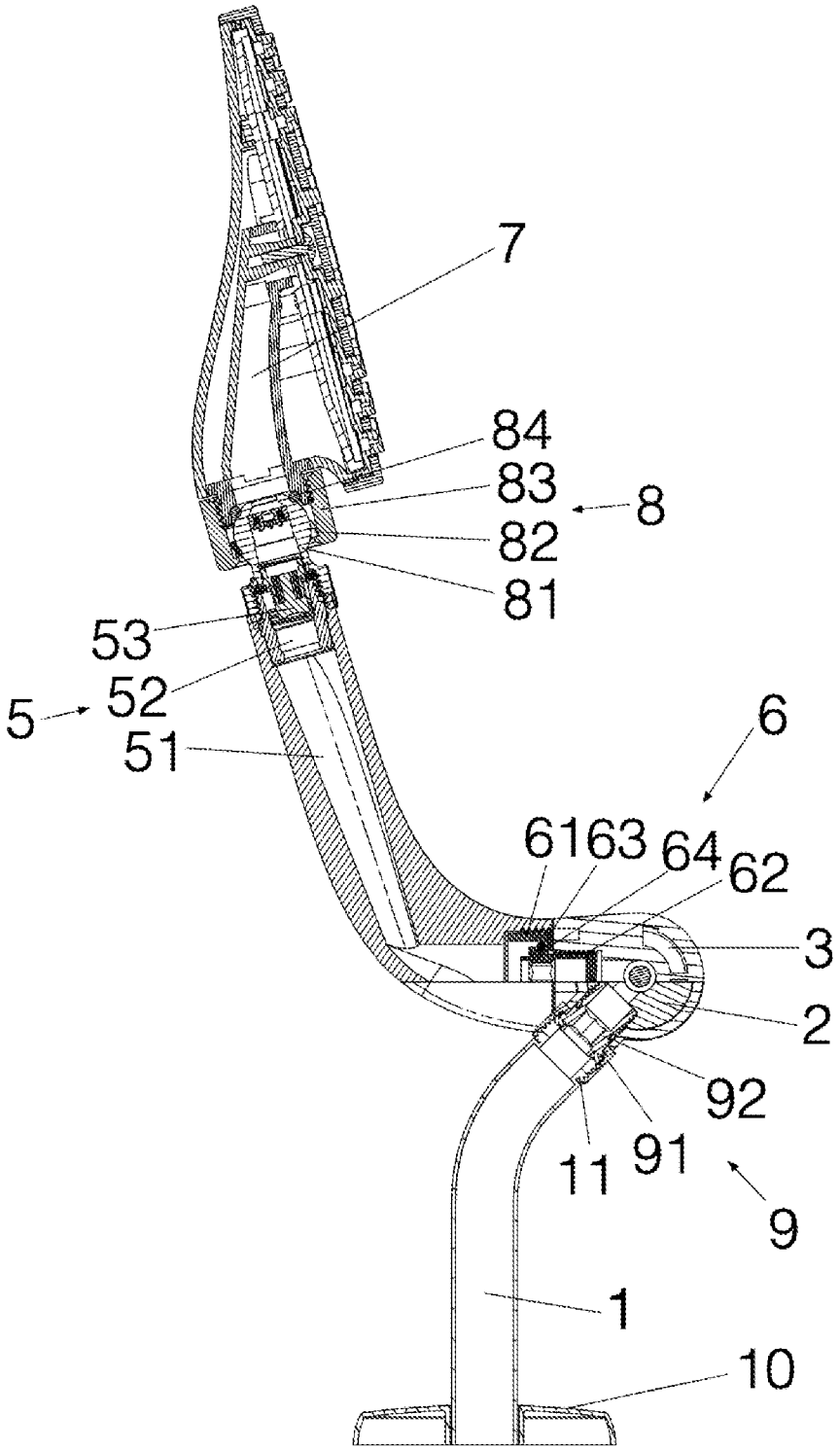
FIG. 3 is a cross-sectional view of FIG. 2 taken along line A-A.
Figure 4:
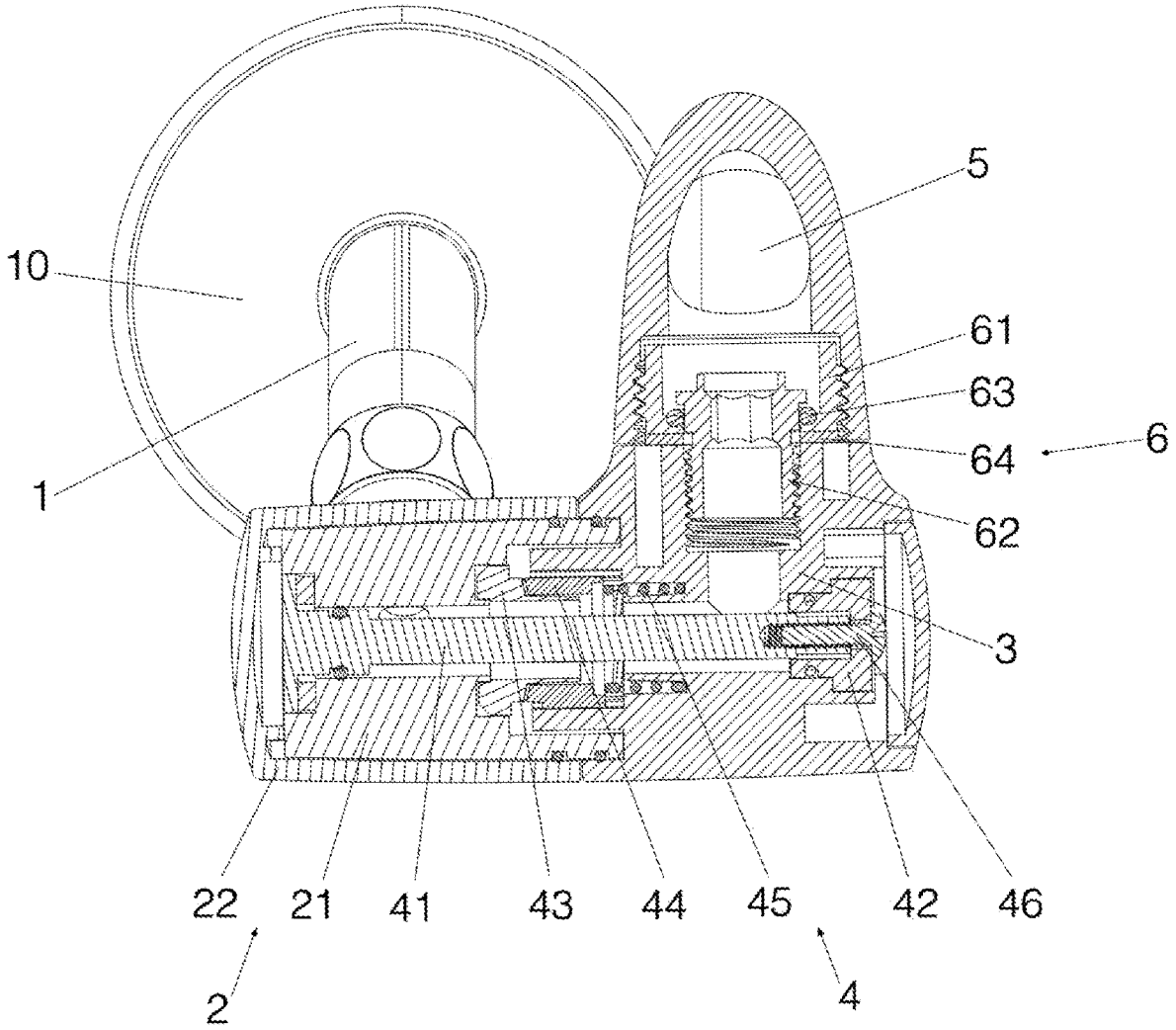
FIG. 4 is a cross-sectional view of FIG. 2 taken along line B-B.

Referring to FIG. 1 to FIG. 4, FIG. 1 to FIG. 4 show an embodiment of an out-of-wall water discharging device. In an embodiment, the out-of-wall water discharging device includes a connecting pipe 1, a fixing base 2, a rotating base 3, a clutch assembly 4, a rotating tube 5, a connecting element 6, a water discharging member 7, a ball head element 8, and a decorative cover 10.

The connecting pipe 1 communicates with the pipeline embedded in the wall and extends out of the wall. The connecting pipe 1 may be a straight pipe or a curved pipe. In this embodiment, a curved pipe is used, and the plane defined by the central axis of the connecting pipe is perpendicular to the wall and perpendicular to the ground as well. The free end of the connecting pipe 1 is provided with a connecting pipe joint 11 having an external thread.

The fixing base 2 includes a fixing base inner core 21 and a fixing base outer casing 22 sleeved on the fixing base inner core 21. Specifically, the fixing base inner core 21 is substantially a cylindrical body, and a first through hole is arranged on the fixing base inner core 21 in the axial direction thereof, and an outer edge surface of the cylindrical body of the fixing base inner core 21 is provided with a water inlet that communicates with the first through hole, and one end of the first through hole in the axial direction is a water outlet of the fixing base inner core 21. The fixing base 2 and the connecting pipe 1 are securely connected through a pipe joint element 9. Specifically, the pipe joint element 9 includes a connecting nut 91 and a connecting joint 92; the connecting joint 92 is provided with a water passage therein, one end of the connecting joint 92 is screwed with the water inlet of the fixing base inner core 21 and the other end of the connecting joint 92 is provided with a position-limiting protrusion. The connecting nut 91 is sleeved on the connecting joint 92, and one end of connecting nut 91 is provided with a position-limiting retaining ring, and the other end thereof is provided with an internal thread to be screwed with the external thread of the connecting pipe joint 11. After the fixing base 2 and the connecting pipe 1 are fastened, the position-limiting retaining ring is pressed against the position-limiting protrusion.

The rotating base 3 is substantially a cylindrical body, and is provided with a second through hole in the axial direction thereof. The outer edge surface of the cylindrical body thereof is provided with a water outlet communicating with the second through hole, and one end of the second through hole is a water inlet of the rotating base 3. The first through hole communicates with the second through hole. The rotating base 3 is rotatable relative to the fixing base 2 along a first axis, wherein the first axis coincides with the axis of the first through hole and the axis of the second through hole. Generally, after the installation is completed, the first axis is on a horizontal plane and parallel to the wall.

The clutch assembly 4 positions the rotating base 3 at a number of discrete positions when the rotating base 3 is rotated relative to the fixing base 2. Specifically, the clutch assembly 4 includes a connecting pin 41, a connecting sleeve 42, a first gear 43, a second gear 44, and an elastic member 45, wherein the connecting pin 41 has a pin shape, and the pin portion of the connecting pin 41 is located at one end of the fixing base 2, and the rod portion of the connecting pin 41 penetrates the first through hole and the second through hole and is secured to the connecting sleeve 42 through the screw 46, so that the fixing base 2 and the rotating base 3 are locked in the first axial direction. The first gear 43 is sleeved on the connecting pin 41 and non-rotatably connected to the fixing base 2, and is further provided with a first tooth portion facing the rotating base 3; the second gear 44 is sleeved on the connecting pin 41 and non-rotatably connected to the fixing base 3, and can slide along the first axis, and is provided with a second tooth portion thereon matched with the first tooth portion. The elastic member 45 is disposed between the second gear 44 and the rotating base 3. Certainly, in other embodiments, the elastic member 45 can also be disposed between the first gear 43 and the fixing base 2. In this embodiment, the elastic member 45 is a spring. Rotating the rotating base 3 around the first axis, the second gear 44 is disengaged from the first gear 43 and the elastic member 45 is being compressed, and rotating the rotating base 3 continuously, the second gear 44 engages with the first gear 43 under the action of the elastic member 45 to position the rotating base 3 at various discrete positions.

The rotating tube 5 includes a rotating tube body 51, a threaded joint 52 and a filter core 53. One end of the rotating tube body 51 is provided with a water inlet and communicates with the water outlet of the rotating base 3, and the other end thereof is secured with the threaded joint 52, and the threaded joint 52 is provided with an external thread extending from the rotating tube body 51. The filter core 53 is further provided in the threaded joint 52. The rotating tube 5 is rotated relative to the rotating base 3 along the second axis perpendicular to the first axis. The threaded joint 52 is provided with a through hole, and one end of the through hole facing the water discharging member 7 is the water outlet of the rotating tube 5.

The connecting element 6 is configured to connect the rotating tube 5 and the rotating base 3, and includes a first connecting member 61 and a second connecting member 62 which are in a tubular shape, a second sealing ring 63 and a gasket 64. In details, the first connecting member 61 has a tubular shape and has an external thread, and is screwed into the rotating tube 5 with the internal thread of the rotating tube 5. One end of the first connecting member 61 facing the rotating base 3 is internally provided with a first position-limiting portion with a ring shape. The second connecting member 62 also has a tubular shape, and one end thereof has an external thread, and is screwed into the rotating base 3 with the internal thread of the water outlet of the rotating base 3, and the other end thereof protrudes from the end surface of the rotating base 3 and extends into the first connecting member 61, and is externally provided with a second position-limiting portion with a ring shape. The first position-limiting portion and the second position-limiting portion are engaged to make the first connecting member 61 and the second connecting member 62 undetachable. The second sealing ring 63 is disposed between the first position-limiting portion and the second position-limiting portion. The gasket 64 is disposed between one surface of the first position-limiting portion facing the rotating base 3 and the end surface of the water outlet of the rotating base 3. After the connection is completed, the gasket 64 is matched with the end surface of the water outlet of the rotating base 3, facilitating the rotating tube 5 to rotate relative to the rotating base 3. Since the first connecting member 61 is screwed into the rotating tube 5, the end surface of the rotating tube 5 and the end surface of the rotating base 3 are close to each other, so that an aesthetic sense of the configuration can be improved and the structure is simple.

The water discharging member 7 is a shower head. Certainly, any component having a water discharging end, such as a faucet, can also be used. The water discharging member 7 communicates with the rotating tube 5.

The ball head element 8 connects the rotating tube 5 and the water discharging member 7 to make the water discharging member 7 rotate three-dimensionally relative to the rotating tube 5 or rotate in the third axial direction. Specifically, the third axis coincides with the axis of the water inlet of the water discharging member 7. The ball head element 8 includes a ball head water passing member 81, a ball head sleeve 82, a ball head cover 83, and a first sealing ring 84. One end of the ball head water passing member 81 is screwed with the threaded joint of the rotating tube 5, and a water passing through hole is provided on the ball head water passing member 81 and communicates with the water outlet of the rotating tube 5. The ball head sleeve 82 is sleeved on the outer periphery of the ball head water passing member 81. In this embodiment, the ball head sleeve 82 is sleeved on the side closer to the rotating tube 5 with the largest outer diameter of the ball head water passing member 81. The ball head cover 83 is a barrel with a through hole at the bottom, the barrel opening faces the water discharging member 7 and is screwed to the water discharging member 7, and the through hole at the bottom of barrel allows the ball head water passing member 81 to pass through. The ball head cover 83 is also pressed against the ball head sleeve 82 along its axial direction (coincide with the axis of the water inlet of the water discharging member 7), and further makes the ball head water passing member 81 and the water discharging member 7 press against the first sealing ring 84.

The decorative cover 10 is configured to cover the position where the connecting pipe 1 protrudes out of the wall.

In the specific assembly process of the embodiment, the decorative cover 10 is first sleeved on the connecting pipe 1, and the connecting joint 92 is engaged with the connecting nut 91, the connecting joint 92 and the fixing base inner core 21 are screwed together, and then the connecting pipe 1 and the connecting nut 91 are screwed together, and the first gear 43 and the fixing base inner core 21 are non-rotatably engaged. The elastic member 45 and the second gear 44 are assembled to the rotating base 3, and then the connecting pin 41 penetrates the fixing base inner core 21, the first gear 43, the second gear 44, the elastic member 45, and the rotating base 3, and is locked with the connecting sleeve 42 through the screw 46, and then the fixing base outer casing 22 is sleeved on the fixing base inner core 21. Thereafter, the first connecting member 61 and the second connecting member 62 are engaged and the second sealing ring 63 is placed therebetween, and then the second connecting member 62 is screwed to the rotating base 3 after passing through the gasket 64. When the screwing is tight, the rotating tube 5 is pulled outward. Meanwhile, the first connecting member 61 is screwed to the rotating tube body 51, the filter core 53 is placed in the threaded joint 52, and the threaded joint 52 is fixed to the other end of the rotating tube body 51. Next, the ball head water passing member 81 is screwed with the threaded joint 52 after passing through the ball head sleeve 82 and the ball head cover 83, and then the first sealing ring 84 is placed between the ball head water passing member 81 and the water discharging member 7, and the ball head cover 83 is screwed with the water discharging member 7 to complete the installation. Finally, the connection pipe 1 is connected to the pipeline in the wall, and present disclosure is ready for use.

In this embodiment, the rotating base 3 is rotatable in the first axial direction, the rotating tube 5 is rotatable in the second axial direction, and the water discharging member 7 is rotatable three-dimensionally or in the third axial direction, thereby realizing the rotation in at least three axial directions to adjust the angle of the water discharging end.

What is claimed is:

1. An out-of-wall water discharging device, characterized in comprising:

a connecting pipe communicating with a pipeline in a wall and extending out of the wall;

a fixing base securely connected to and communicating with the connecting pipe;

a rotating base rotatably connected to and communicating with the fixing base along a first axis;

a clutch assembly positioning the rotating base at a number of discrete positions when the rotating base is rotated relative to the fixing base;

a rotating tube rotated relative to the rotating base along a second axis perpendicular to the first axis and communicating with the rotating base;

a connecting element comprising a first connecting member and a second connecting member in a tubular shape; the first connecting member being screwed into the rotating tube, and a first position-limiting portion being disposed in one end of the first connecting member facing the rotating base; one end of the second connecting member being screwed into the rotating base, the other end thereof extending from the rotating base and extending into the first connecting member and is externally provided with a second position-limiting portion; the first position-limiting portion and the second position-limiting portion being engaged and an end surface of the rotating tube and an end surface of the rotating base being close to each other;

a water discharging member communicating with the rotating tube; and a ball head element connecting the rotating tube and the water discharging member to make the water discharging member rotate three-dimensionally relative to the rotating tube or rotate in a third axial direction.

2. The out-of-wall water discharging device according to claim 1, wherein the water discharging member is a shower head.

3. The out-of-wall water discharging device according to claim 1, wherein the water discharging member is a faucet.

4. The out-of-wall water discharging device according to claim 1, wherein the first axis is parallel to the wall.

5. The out-of-wall water discharging device according to claim 2, wherein the first axis is parallel to the wall.

6. The out-of-wall water discharging device according to claim 3, wherein the first axis is parallel to the wall.

7. The out-of-wall water discharging device according to claim 4, wherein the connecting element is further provided with a gasket between the first position-limiting portion and the end surface of the rotating base; the gasket is matched with the end surface of the rotating base.

8. The out-of-wall water discharging device according to claim 5, wherein the clutch assembly comprises a connecting pin, a connecting sleeve, a first gear, a second gear and an elastic member; the fixing base is provided with a first through hole, the rotating base is provided with a second through hole communicating with the first through hole; the connecting pin penetrates the first through hole and the second through hole and is secured to the connecting sleeve to lock the fixing base and the rotating base along a first axial direction; the first gear is sleeved on the connecting pin and is non-rotatably connected to the fixing base, and is further provided with a first tooth portion facing the rotating base; the second gear is sleeved on the connecting pin and is non-rotatably connected to the rotating base, and is provided with a second tooth portion that cooperates with the first tooth portion; the elastic member is disposed between the first gear and the fixing base or between the second gear and the rotating base; the rotating base is rotated along a first axis, the second gear disengages from the first gear to compress the elastic member, and the rotating base is rotated continuously, the elastic member drives the second gear to engage with the first gear, such that the rotating base is positioned at various discrete positions.

9. The out-of-wall water discharging device according to claim 5, wherein the ball head element comprises a ball head water passing member, a ball head sleeve, a ball head cover and a first sealing ring; the ball head water passing member is secured with and communicates with the rotating tube; the ball head sleeve is sleeved on an outer periphery of the ball head water passing member; the ball head cover is a barrel provided with a through hole at the bottom, a barrel opening faces the water discharging member and is secured with the water discharging member, the through hole at the bottom of the barrel allows the ball head water passing member to pass through; the ball head cover is also pressed against the ball head sleeve along an axial direction thereof, such that the ball head water passing member and the water discharging member are sealedly communicated with each other through the first sealing ring.

* * * * *